United States Patent [19]

Schenker

[11] 4,310,044

[45] Jan. 12, 1982

[54] ACCESS SHIELD FOR UNCOVERED REFRIGERATED UNITS

[76] Inventor: M. Allan Schenker, 17046 Burbank Blvd., #8, Encino, Calif. 91316

[21] Appl. No.: 38,230

[22] Filed: May 11, 1979

[51] Int. Cl.[3] ..... E06B 3/80; E06B 9/14

[52] U.S. Cl. ..... 160/329; 312/116; 312/138 R; 312/297

[58] Field of Search ..... 160/120, 166 A, 172, 160/176, 179, 184, 236, 327, 328, 329, 332; 312/116, 122, 138 R, 297; 62/246

[56] References Cited

U.S. PATENT DOCUMENTS

| | | | |
|---|---|---|---|
| 2,041,258 | 5/1936 | Mitchell | 160/236 |
| 4,086,950 | 5/1978 | Power | 160/332 |
| 4,186,790 | 2/1980 | Schenker et al. | 160/329 |

FOREIGN PATENT DOCUMENTS

| | | | |
|---|---|---|---|
| 2311595 | 9/1973 | Fed. Rep. of Germany | 160/332 |

*Primary Examiner*—Philip C. Kannan

*Attorney, Agent, or Firm*—Richard H. Zaitlen

[57] ABSTRACT

Energy losses from market refrigerated display cases, which are normally open, can be dramatically reduced by use of an access shield according to the present invention. The access shield comprises a plurality of transparent and resilient panels, each panel being adjacent to at least one other and having an overlapping relationship with the adjacent panel. The panels may be mounted in a rigid frame and allow access therethrough by stretching and bending of one or more of the panels along the overlapped line. The plurality of panels may also be fitted to a spring-tensioned roller and stretched across the aperture of the refrigerated display case. In another embodiment, the plurality of panels may each be attached at an opposite end to a holder having a bow tie shaped protrusion which is urged into a receiving indentation in a fixture to temporarily lock the panel in a predetermined position and yet to permit free rotation within a sector to facilitate access. Other embodiments are also disclosed.

18 Claims, 32 Drawing Figures

FIG.1
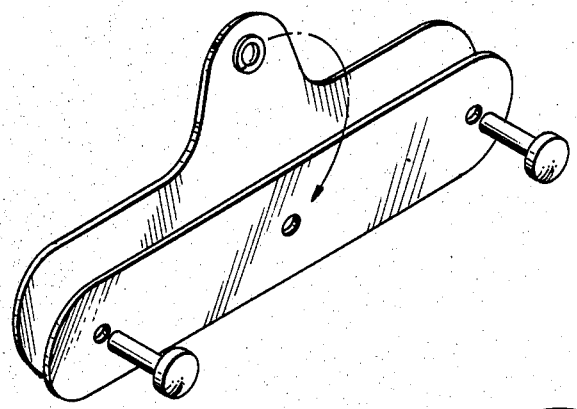
FIG.2
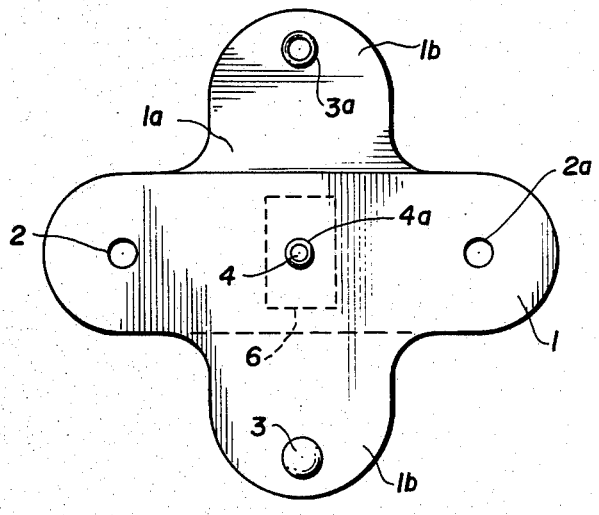
FIG.3
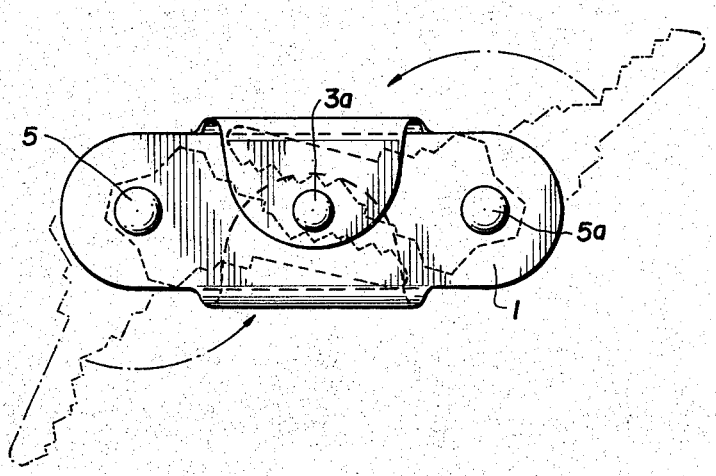
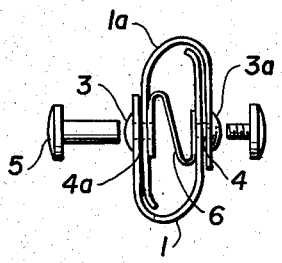
FIG.4

ACCESS SHIELD FOR UNCOVERED REFRIGERATED UNITS

BACKGROUND OF THE INVENTION

1. Field of the Invention.

The present invention relates to the field of refrigerated apparatus and in particular to means for temporarily opening and closing access apertures to refrigerated devices.

2. Description of the Prior Art.

Refrigerated display apparatus in markets have typically used open refrigerated units both having horizontal openings and generally vertical openings. In those cases where the refrigerated unit has been provided with a barrier over the access opening, typically swinging or sliding glass doors have been provided.

The use of plastic or glass doors over refrigerated display openings has been limited due to the inconvenience of use, the high expense of installation, and high maintenance cost where such glass or plastic is subject to breakage, scratching, or discoloration. In many applications, such glass and plastic doors have provided only limited access to a portion of the refrigerated display unit or are cumbersome to open and remove merchandise from the refrigerated case inasmuch as such units typically incorporate a means for urging the heavy door back into the closed position.

What is needed is an access barrier for use with refrigerated display units which is simple, rugged, economical, and which provides substantially free access into and out of the refrigerated unit while effectively isolating the interior of the refrigerated unit from the ambient environment.

BRIEF SUMMARY OF THE INVENTION

The present invention is an apparatus for forming and mounting a shield across an aperture across which a temperature gradient is maintained while still permitting substantially free access therethrough. The apparatus comprises a plurality of substantially transparent panels and a means for disposing the plurality of panels across the aperture and tensioning the plurality of panels. Each one of the plurality of panels is adjacent to at least one other one of the plurality of panels. By reason of this combination, a thermal barrier is formed across the aperture without substantially prohibiting free movement therethrough.

The invention may further be characterized by the embodiment wherein each one of the plurality of panels assumes an abutting or overlapping relationship with at least one other one of the plurality of panels in at least one configuration. In another embodiment, each one of the plurality of panels may be resilient to facilitate access therethrough.

The means for disposing the plurality of panels across the aperture and tensioning the plurality of panels may include a frame rigidly holding the opposing edge segments of each one of the plurality of panels. In another embodiment this means may include a spring means for maintaining tension on the plurality of panels. In yet another embodiment this means may include a rotating means for permitting rotation of at least one edge segment of each one of the plurality of panels. In another embodiment the panels are secured within a rail member having an arcuate guide member which secures the rail member within an arcuate track member, thereby permitting rotation of the rail member about the longitudinal axis of the track member.

The present invention and its various embodiments as set forth briefly and generally above can be better understood in connection with the following figures in light of the detailed description of the preferred embodiments.

DESCRIPTION OF THE DRAWINGS

FIG. 5 is yet another embodiment of the present invention showing a fragmented plan view of a means for attaching each of the panels into a louvered array;

FIG. 6 is an exploded perspective view showing one embodiment of the device which may be used to rotatably attach the panels to a track as shown in FIG. 5;

FIG. 20 illustrates a refrigerated display which requires forward rotation of the lower mounting means;

FIG. 21 is a perspective view of the track member and lock bushings;

FIG. 22 is a side plan view of the lock bushing;

FIG. 23 is an edge view of the lock bushing;

FIG. 25 is a perspective of a section of the coupling member;

FIG. 27 is an end view of an alternate embodiment of the panels;

DETAILED DESCRIPTION OF THE PREFERRED EMBODIMENT

The present invention is an access shield for thermally isolating an aperture in a refrigerated device from the ambient environment while permitting access through the aperture. The access shield comprises a plurality of resilient, substantially transparent panels. The plurality of panels have at least one configuration wherein each one of the panels is adjacent to and partially overlaps at least one other one of the panels. The apparatus further comprises a means for disposing a plurality of panels across the aperture and tensioning each one of the panels across the aperture. By reason of this combination of elements thermal energy flow across the aperture is greatly reduced. The plurality of panels may also include at least one opening and typically a plurality of openings through the plurality of panels to permit a predetermined airflow through the opening and the panel array when in the normally closed configuration.

The utility, and the manner in which the present invention may be fabricated and used, can be better understood by considering the following description in conjunction with the figures.

Figure 1:
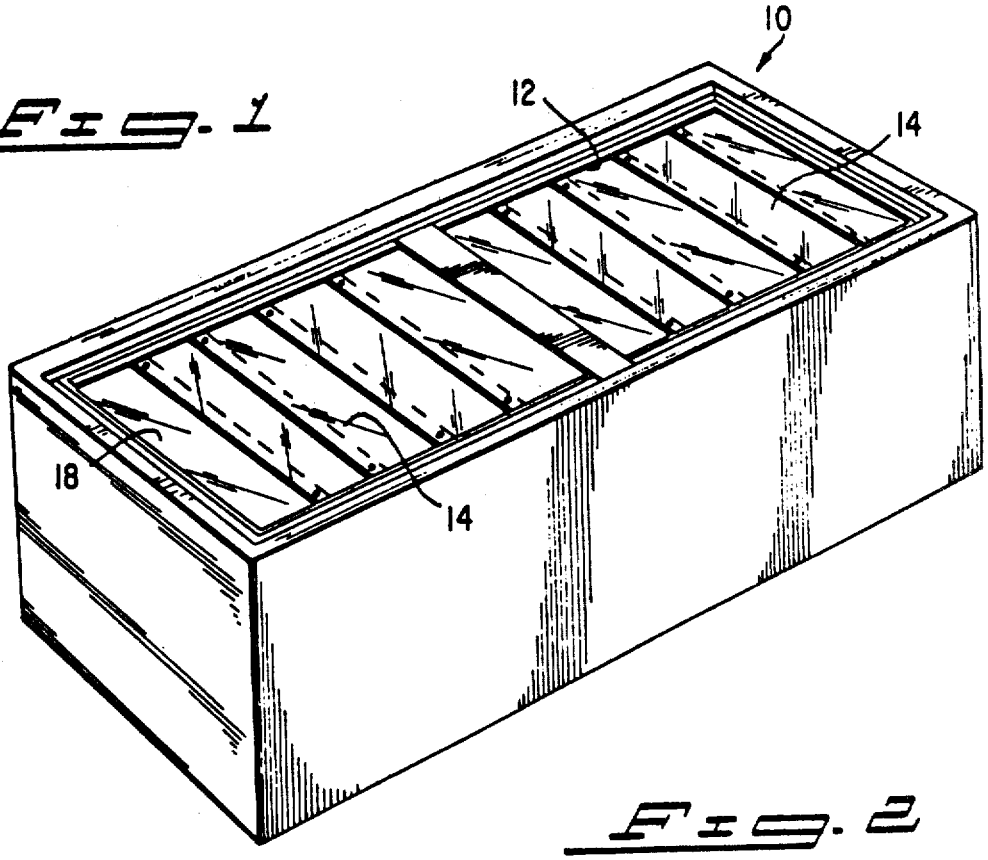
FIG. 1 is a perspective view showing one embodiment of the invention applied to a horizontal refrigerated display case.

In FIG. 1, a typical refrigerated display device 10 is shown as having its upper, horizontal aperture 12 covered by an array 14 of panels fabricated according to the present invention. Typically, the panels are substantially transparent, such as a transparent plastic, thereby permitting the consumer to freely view the contents through refrigerated display device 10. Array 14 of panels substantially close aperture 12 thereby reducing the amount of thermal energy lost across aperture 12 to the ambient environment. When the consumer desires to make a selection and remove an article from the interior of refrigerated display device 10 he merely thrusts his hand through array 14 and grasps the underlying article. The panels of array 14 will yield or give way and permit both the consumer's hand to be thrust inward to the interior of refrigerated display device 10 and to permit the withdrawal of even bulky articles, such as frozen turkeys, without substantial interferene. The embodiment of the present invention particularly shown in FIG. 1 is better seen in plan view in FIG. 2.

Figure 2:
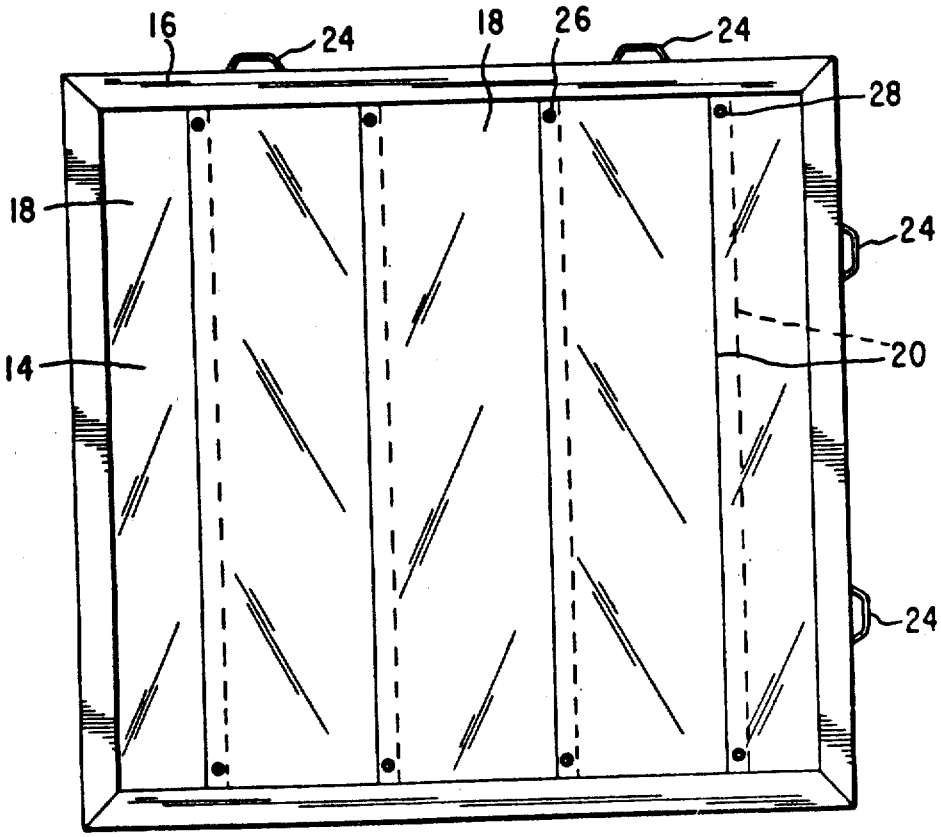
FIG. 2 is a plan view of the embodiment illustrated in FIG. 1.

FIG. 2 illustrates one embodiment of a means for disposing the plurality of panels across aperture 12 of refrigerated display device 10 and tensioning the plurality of panels. As shown in FIG. 2 this means includes a frame 16 which may be generally rectangular and typically made from extruded or rolled form aluminum, plastic or other compositions. Within frame 16 is a plurality of panels 18. In the embodiment illustrated, panels 18 are shown as having a generally rectangular shape, with a long or major axis many times greater than the shorter or minor axis. Throughout the specification the panels are shown as rectangular panels with straight edges. However, it must be understood that the panels may assume any geometric shape well known to the art including parallelograms, triangles, circles and even irregular shapes. Edges 20 of panels 18 need not be straight lines but may be curved, serrated, jagged, feathered or any configuration known to the art.

Frame 16 is coupled to opposing edge segments 22 of each one of the plurality of panels 18. Frame 16 may also include resilient springs 24 on at least two adjacent edges of frame 16. Frame 16 will typically be mounted in a perimeter mating J-channel track which is coupled to refrigerated display device 10. Springs 24 will be compressed with the J-channel perimeter and to adjacent H-channel multi-track, thereby securing frame 16 across aperture 12 in a manner well known to the art.

As shown in FIG. 2, panels 18 are disposed within frame 16 in an overlapping relationship. Each panel overlaps the next adjacent panel along at least a portion of the length of panel 18. Typically, the panel is made of a plastic material which has an inherent resiliency. When the consumer places his hand through the plane defined by panels 18, the panels will twist, stretch and deflect to permit the hand to move through substantially any point of array 14 of panels 18. Similarly, when the user withdraws his hand the natural resiliency of panels 18 will tend to bring the panels back into a substantially flat, sealing and/or overlapping relationship as shown in FIG. 2. Thus, array 14 of panels 18 form a thermal barrier which tends to maintain the temperature gradient across aperture 12 of refrigerated display device 10, and yet permits user access to the interior of refrigerated display device 10.

Figure 3:
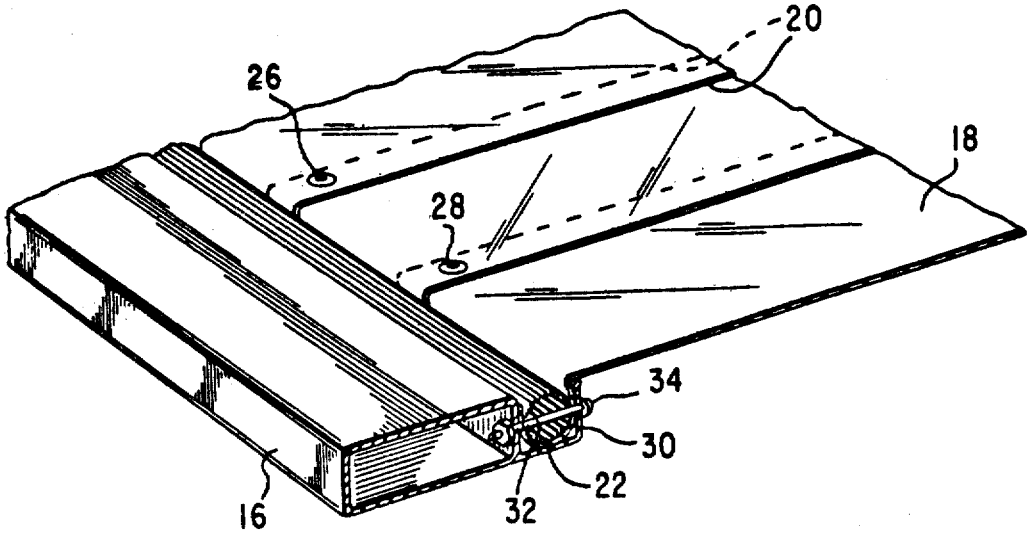
FIG. 3 is a section perspective view showing details of the edge of the plurality of panels and its attachment to the frame of FIG. 2.

As shown in FIG. 1 and as shown in greater clarity in FIG. 3, array 14 of panels 18 include a plurality of openings 26. In the embodiment illustrated in FIGS. 2 and 3, openings 26 are shown as disposed at the overlap between edges 20 on adjacent panels 18. Metal grommets 28 are fitted through the overlapping portion of both panels 18 and define opening 26. The size and number of grommets 28 are selected according to design principles well understood in the art to allow a predetermined amount of airflow through array 14 of panels 18, and to maintain positive, lateral tension between overlapping adjacent panels. Grommets 28 will permit airflow to prevent condensation which might otherwise be established because of the temperature gradient across array 14. Further, a limited amount of air circulation might be necessary in a refrigerated cabinet to avoid the accumulation of undesired odors or staleness. In the illustrated embodiment, grommets 28 are shown as disposed near edge segments 22 and thereby are substantially non-interfering with the separation of panels 18 along edges 20. Grommets 28 thus, also serve to aid as a mechanical fastener between adjacent panels 18. It is to be understood, however, that openings 26 may be disposed in array 14 in any manner desired according to well known design principles and that grommets 28 may be eliminated and a wide number of equivalent types of fasteners substituted.

FIG. 3 shows one way in which panels 18 may be fastened to frame 16. End segments 22 are disposed in a U-shaped channel 30 which may be formed as an integral part of an extruded aluminum frame 16. A resilient cord 32 having longitudinally ribbed serrations is press-fit into U-channel 30 over end segments 22 in a manner well known to the art. Cord 32 is well known in the screening industry and its dimensions, composition and design may be appropriately selected to optimize performance in the application in the present invention in view of the physical properties of panels 18 and the temperatures at which frame 16 will be maintained. Cord 32 may be secured to frame 16 by insertion of rivet 34 through selected ones of end segments 22, cord 32 and U-channel 30. Cord 32 may be temporarily secured by substituting screws or other temporary fasteners in place of rivet 34. The means used to fasten end segments 22 to frame 16 is shown by way of example only and any other means known to the art may be employed or devised depending in part upon the structure of frame 16.

Figure 4:
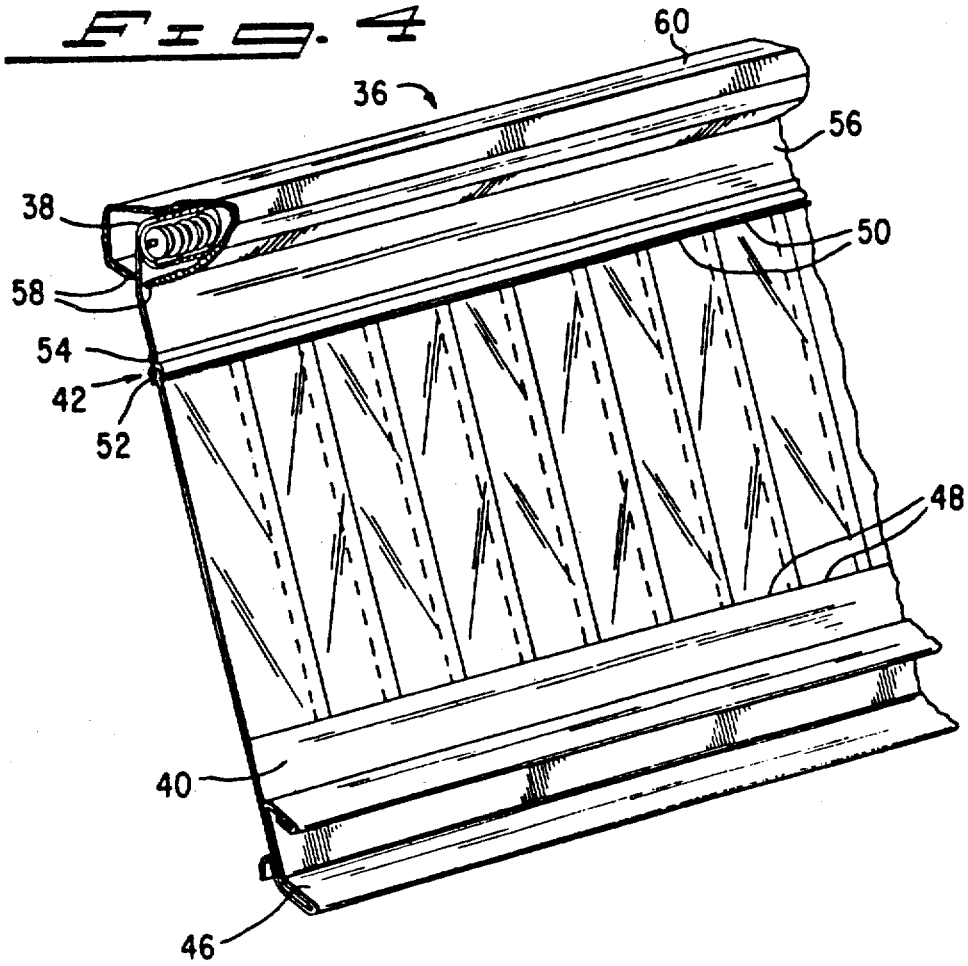
FIG. 4 shows another embodiment of the present invention wherein tension on the plurality of panels is maintained by a spring-loaded roller.

FIG. 4 illustrates another embodiment of the present invention wherein array 14 of panels 18 are disposed across an aperture in combination with a tensioning device 36, such as a spring tensioned roller 38. In the embodiment illustrated in FIG. 4 panels 18 are overlapping in the manner as described in regard to the embodiment of FIGS. 2 and 3 but terminate or are coupled at one end to an end panel 40 and at the other end to a fixture 42. End panel 40 may likewise be coupled to a receiving fixture 46 which in turn is attached to refrigerated display device 10. The manner of coupling end panel 40 to fixture 46 may be effected by any means well known to the art. Ends 48 of panels 18 may be coupled to end panel 40 by integral molding, adhesion, thermal bonding or by any other known means.

Ends 50 of panels 18 are illustrated in FIG. 4 as terminating in a rail or fixture 52. Rail 52 is slidily disposed or otherwise temporarily coupled to a mating rail 54. Together, rails 52 and 54 comprise coupling fixture 42. Mating rail 54 is coupled to a flexible end panel 56 which is typically of the same material as panels 18. End panel 56 in turn is coupled to roller 38 within tensioning device 36. The design and detail of tensioning device 36 is well known to the art and has been used in the window screening industry. The spring of tensioning device 36 is wound to a predetermined condition to maintain a selected amount of tension upon end panel 56. When fixture 46 is uncoupled from the refrigerated unit, the spring tension on roller 38 will tend to roll end panel 56 around roller 38 thereby pulling array 14 upward into tensioning device 36. After end panel 56 has been wrapped around roller 38, coupling fixture 42, and more particularly, rail 54 will contact lips 58 of housing 60 of tensioning device 36. The relative dimension of the opening between lips 58 and rail 54 are such that further withdrawal of end panel 56 around roller 38 is prohibited. At this point, that portion of array 14 below rail 52 is no longer under tension. The lower portion of array 14 may then be conveniently removed for replacement or repair.

The embodiment of FIG. 4 will find particular adaptation in vertical refrigerated display cases having large apertures 12 which may not be conducive for use with large sized frames 16. The embodiment of FIG. 4 is also particularly useful to maintain a selected tension on panels 18 inasmuch as end panel 56 is relatively short and the variation of tension on roller 38 is small between the fully extended and fully retracted configuration of end panel 56. Furthermore, the embodiment to FIG. 4 will automatically compensate for stretching and fatigue which may occur over time and with usage of array 14 to maintain sealing or closure of edges 20 by spring tension.

FIG. 5 shows yet another embodiment of the present invention wherein panels 18 are arranged and configured in an overlapping relationship in a louvered type array to form a substantially flat shield. The array includes a plurality of resilient panels each having a fixture at each end of each panel to permit independent rotation of each end of the panel and to maintain a predetermined tension on each panel. As shown in FIG. 5 a means for tensioning and disposing panels 18 across aperture 12 may be comprised of a rotatable fixture 62. Panels 18 may extend on each side outwardly from fixture 62, thereby establishing an overlapping relationship with the adjacent panel. In addition to the inherent resiliency and twisting of panels 18, rotatable fixture 62 will increase the degree and ease of access through array 14 by permitting end segments 22, held by rotatable fixture 62, to rotate. As described below, fixture 62 is designed to assume a temporarily locked position wherein each of panels 18 will be held in alignment to the adjacent panels in an overlapping or abutting relationship to form the thermal barrier desired.

Figure 7:
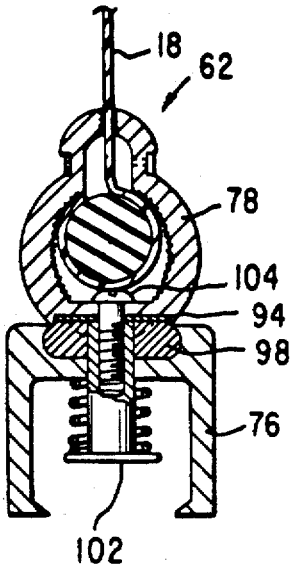
FIG. 7 is a cross-section taken through section 7—7 of FIG. 6.

The operation and structure of fixture 62 can be better unerstood by viewing FIGS. 6 and 7. In FIG. 6 one embodiment of fixture 62 is shown in exploded perspective view. Fixture 62 is comprised of a rotatable holder 64 coupled to edge segment 22 of one of panels 18 and a receiving fixture 70. Holder 64 has a center pivot hole 66 and at least one protrusion 68 extending from holder 64. Protrusion 68 is off-set from pivot hole 66. Receiving fixture 70 is also provided with a pivot hole 66. Receiving fixture 70 has at least one indentation 72 for receiving protrusion 68. Rotatable fixture 64 also includes a spring-loaded pivot pin 74 which is disposed in pivot hole 66 in receiving fixture 70. Spring-loaded pivot pin 74 tends to urge protrusion 68 into indentation 72 thereby temporarily locking rotatable fixture 64 in a selected position. Fixture 64 rotates freely when in a configuration other than the temporarily locked position upon application of a torsional force to a panel 18. Upon removal of the torsional force the panel tends to return to the selected or temporarily locked position. The force of the user's hands and arms against edges 20 of panels 18 is sufficient to rotate fixture 64 from the temporarily locked position to a free-swinging position. Similarly, after withdrawal of the hands and arms of the user fixture 64 will rotate back to the locked position, thereby returning array 14 of panels 18 to a substantially flat and sealed array.

Holder 64 in the particular embodiment illustrated in FIG. 6 is shown as being comprised of a clip 78 having an internal chamber 80 and a neck 82. Both chamber 80 and neck 82 are provided with a plurality of internal longitudinal indentations or ridges which form jaws which helped to grasp and secure the material of panel 18 when it is inserted into clip 78. The material of panel 18 may be wound about a cylinder with a tabbed or keyed end for use with an appropriate tool. When the desired amount of material has been withdrawn within clip 78 and the tension adjusted on panel 18, a clip retainer spring 84 may be disposed in groove 86 between neck and chamber 80 of clip 78. Retainer spring 84 extends around the ends of clip 78 to the opposite groove 86 and has a nipple 88 which is urged by the resiliency of retainer spring 84 into a locking hole 90 provided in groove 86. Dimension 92 of retainer spring 84 is chosen such that when locked into hole 90, retainer spring 84 will squeeze neck 82 of clip 78 thereby causing the jaws of neck 82 and chamber 80 to bite into the material of panel 18.

A wing member 94 is shown in FIG. 6 as mating in a recess 96 provided in the bottom of clip 78. Indentation 72, which is the female counterpart of protrusion 68, is formed in a nest member 98. Nest member 98 mates in a correspondingly shaped recess 100 formed in the upper portion of track 76 in such a manner that travel along track 76 is permitted. Indentation 72, in the embodiment of FIG. 6, is shown as the double lobed, symmetric bow tie shape corresponding to protrusion 68 of wing member 94. In the illustrated embodiment, wing member 94 is provided with a double lobed protrusion 68 which is shaped in the form of a bow tie, with its center symmetrically disposed about pivot hole 66. Many other shapes for protrusion 68 may be used without departing from the spirit and scope of the present invention. For example, each lobe may be in the shape of a split, truncated tear. That portion of the tear shape nearest pivot hole 66 has sufficient thickness or extension from the plane of wing member 94 to prevent its displacement from indentation 72 in nest member 98. In other words, spring-loaded pivot pin 74 will be completely compressed before protrusion 68 can be rotated and completely displaced from indentation 72. This will prevent the complete displacement of protrusion 68 from indentation 72 when the user's hand in contact with panel 18, causes wing member 94 to rotate with respect to nest member 98. Also as a result, the spring tension exerted on protrusion 68 from spring-loaded pin 74 will tend to urge protrusion 68 back into a fully mating position within indentation 72.

As shown in cross-section in FIG. 7, spring-loaded post 74 is disposed through pivot hole 66 and clip 78, wing member 94, nest member 98 and track 76. As shown in FIG. 7 spring-loaded post 74 includes two mating members, screw 104 and post 102. An access hole 83 is provided at the appropriate point in neck 82 of clip 78 to permit a tool to be inserted therethrough for the purpose of tightening screw 104. The materials of holder 64 and receiving fixture 70 may be chosen according to well known principles to optimize the application according to temperature, usage and durability. For example, wing member 94 and nest member 98 may be composed of self-lubrication Teflon to avoid problems of friction, corrosion, and durability which may otherwise occur if soft metal parts were employed. However, it must be understood that the particular embodiment of FIGS. 6 and 7 are shown only for the purposes of example, and other forms of fixture 62 may be employed within the scope and spirit of the present invention, such as using an integrally molded holder 64 and receiving fixture 70.

Figure 8:
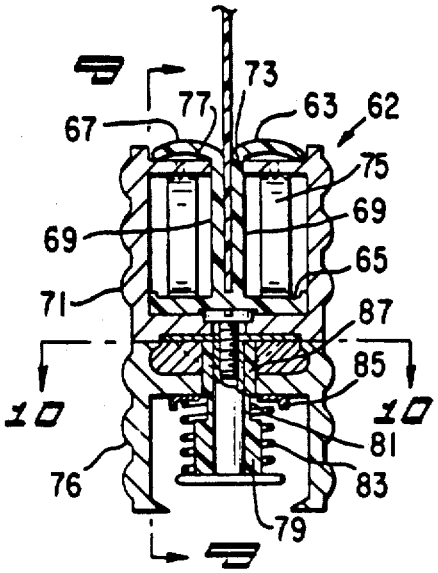
FIG. 8 is a cross-section of another embodiment of a device which may be used to rotatably attach the panels to a track.

FIG. 8 is a cross-sectional illustration of another embodiment of fixture 62. Embodiment of FIG. 8 differs from that of FIGS. 6 and 7 in that panel 18 is coupled to a cuff 63. Cuff 63 may be an integral molded piece having lower flanges 65 and upper flanges 67. Panel 18 is inserted into the space between sides 69 to cuff 63, may extend laterally beyond the edges of sides 69 and may be bonded, fixed or coupled to cuff 63 by any means well known to the art, such as, adhesive bonds, thermal bonding, or mechanical riveting. Cuff 63 is disposed in a clip 71 having a slot 73 through which sides 69 extend. A cuff spring 75 is disposed within clip 71 and provides a compressive spring force between the points of contact between spring 75 and lower flanges 65 of collar 63 and an upper flange 77 of clip 71. Spring 75 may be fixed or coupled to flange 77 by any well known means, such as riveting. This configuration allows cuff 63 to be extended upwardly in clip 71 by tension exerted upon panel 18. Spring 75 will urge cuff 63 downwardly into clip 71 thereby maintaining a predetermined amount of tension on panel 18. The opposite end segment 22 of panel 18 is provided with a similar apparatus and the tension exerted upon panel 18 tends to keep both opposing end segments 22 aligned, one with the other.

Clip 71 is also provided with a wing member 94 and nest member 98 of the type previously described. The fixture is coupled to track 76 by a pivot pin 74 which includes a screw 104 through clip 71 and post 102. In addition, a post sleeve 79 is disposed about post 102. Post sleeve 79 is provided with a reduced neck portion 81 described in greater detail below. Pivot pin 74 is spring loaded as described above by a coil spring 83, but also includes a washer or post spring saucer 85 disposed between spring 83 and lower surface of track 76 which saucer 58 allows post 102 to be slidingly translated along the bottom of track 76.

Figure 10:
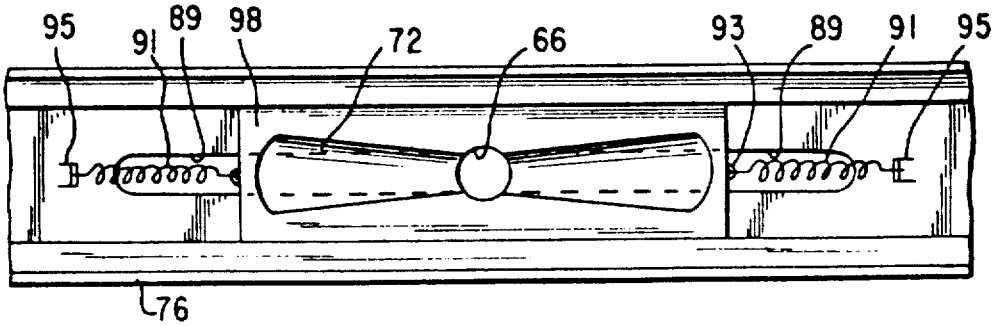
FIG. 10 is a plan view of the embodiment of FIG. 8 taken through section 10—10.

FIG. 10 illustrates in plan view, a nest member 98 disposed in recess 100 of track 76. Shown partially in phantom outline below and extending to each side of nest member 98 is a slotted raceway 89. Raceway 89 is symmetric about pivot hole 66 which is formed in the middle of raceway 89. A spring 91 is coupled between a hook or similar means at one end of nest member 98 and a punched-out tab 95 or similar means in track 76. The opposing end of nest member 98 is provided with a similar spring. When in the equilibrium position, the opposing springs center nest member 98 about pivot hole 66 in slotted raceway 89.

Figure 9:
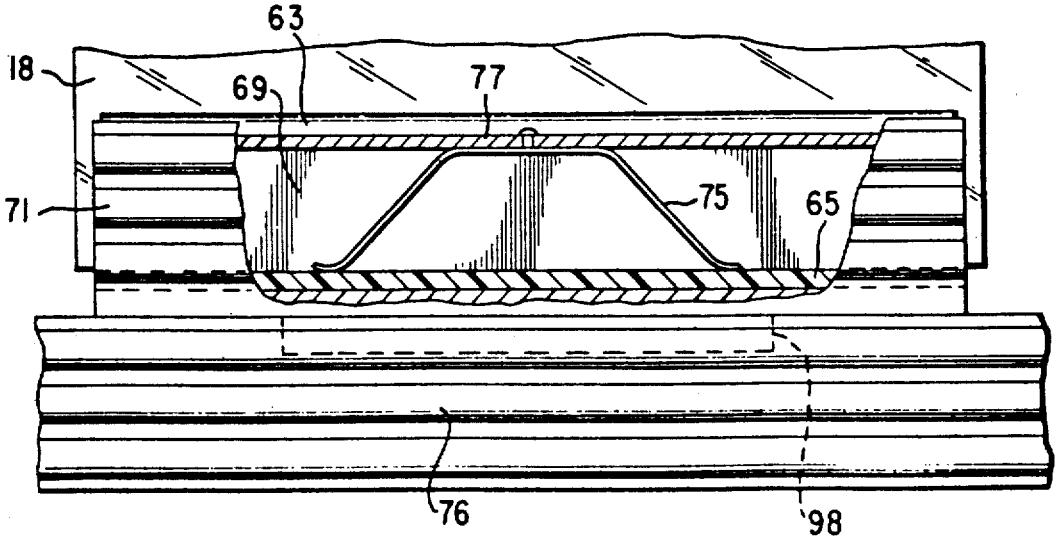
FIG. 9 is a cross-section of the embodiment of FIG. 8 taken through section 9—9.

As best illustrated in FIG. 8, post sleeve 79 is in a first position when wing member 94 is in a configuration in which it fully mates with nest member 98. In this first position, post sleeve 79 has an upper portion 87 extending through pivot hole 66. The diameter of upper portion 87 is chosen such that sufficient clearance is provided for free rotation in pivot hole 66 but any movement along slotted raceway 89 is prohibited. When wing member 94 is rotated with respect to nest member 98, spring 83 will be compressed as wing member 94 rides upward and outward from the fully mating position within nest member 98. This will pull post 102 upwardly through pivot hole 66 together with post sleeve 79. After a predetermined degree of rotation, post sleeve 79 will have been drawn far enough upward to place neck portion 81 in pivot hole 66. The outer diameter of neck portion 81 is such that post sleeve 81 may freely slide along slotted raceway 89. Sufficient clearance is provided between nest member 98 and recess 100 to permit free displacement of nest member 98 when in this second position. Springs 91 will tend to urge nest member 98 back to the equilibrium position wherein post sleeve 81 is aligned with pivot hole 66. Thus, after a predetermined degree of rotation has occurred, the fixture of FIGS. 8, 9 and 10 may also be translated along slotted raceway 89 in either direction to permit further opening between panels 18.

A unique feature of the construction of the wing member 94 and nest member 98 is that it does not allow the protrusion 68 to come completely out of indentation 72. This is accomplished by making the depth of indentation 72 (and thickness of protrusion 68) shown in FIGS. 11 and 12 greater than the distance through which the spring 83 (See FIG. 8) of spring loaded pin 74, may be compressed. Thus, even with the spring 83 fully compressed, some portion of protrusion 68 will be within the volume of indentation 72. This physical relationship will generate a restoring torque which, upon removal of the shopper's arms 225 from between the panels will automatically cause the wing member 94 and nest member 98 to return to their mated and aligned position.

Figure 11:
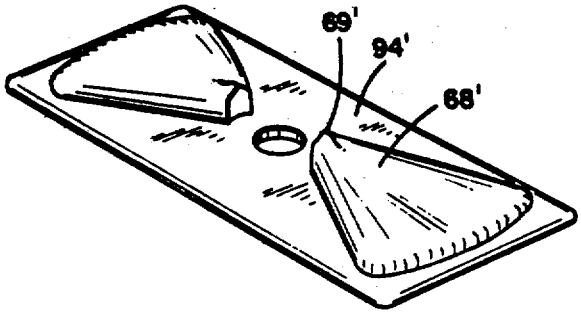
FIG. 11 is a perspective of an alternate embodiment of a member illustrated in FIG. 6.
Figure 12:
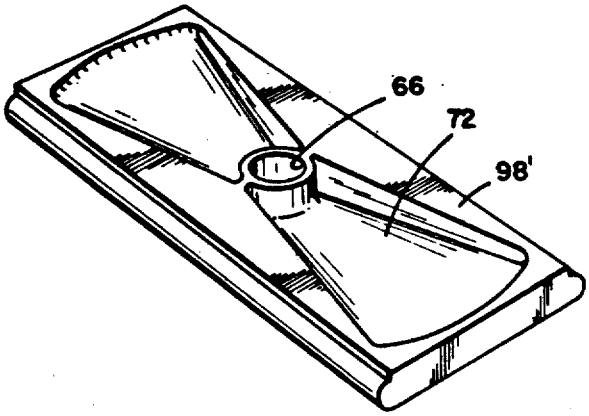
FIG. 12 is a rotated perspective of an alternate embodiment of a second member illustrated in FIG. 6.

An alternate embodiment of the wing member 94 and nest member 98 are shown in FIGS. 11 and 12, respectively. Particular attention is directed to the feature that the portions of the protrusions 68' of the wing member 94' that are nearest the pivot hole 66' are the thickest portions of the protrusions. Indeed a very steep keel-like portion 69 has been provided to ensure that, as stated earlier, even when the wing member 94' is rotated to its maximum, a part of the protrusion 68' (specifically at least the keel-like portion 69) remains within the volume of the indentation 72'. This ensures that the contacting sloping surfaces of the indentations 72' and protrusions 68' in combination with the spring 83 will automatically cause the wing member 94' and nest member 98' to realign upon withdrawal of the shopper's hands from between the panels 18.

This embodiment, then, has a four-fold action. Firstly, a natural and inherent resiliency of panels 18 permit a certain degree of stretching, twisting and bending to facilitate access to a user's hand and arms between adjacent panels. Secondly, spring loaded cuff 63 will provide additional resiliency to panel 18 to further facilitate access through the panel separations. Thirdly, wing member 94 and nest member 98 in conjunction with each of the other elements of the fixture will permit rotation, as described above, to allow end segments 22 of panels 18 to be rotated to even further facilitate access through the panel array. Finally, the combination of each of the above-described elements with post sleeve 81 and slotted raceway 89 permits end segments 22 of each panel to be displaced in either direction to maximize the separation between panels and to allow free access without substantial inhibition. The embodiment of FIGS. 8, 9 and 10, after use, will resume their equilibrium position thereby restoring array 14 of panels 18 to a substantially flat, sealing and/or overlapping relationship to form a thermal barrier across aperture 12.

Additional alternate embodiments of devices used for securing the panels in place across an aperture are illustrated in FIGS. 13 through 31*b*.

Figure 13:
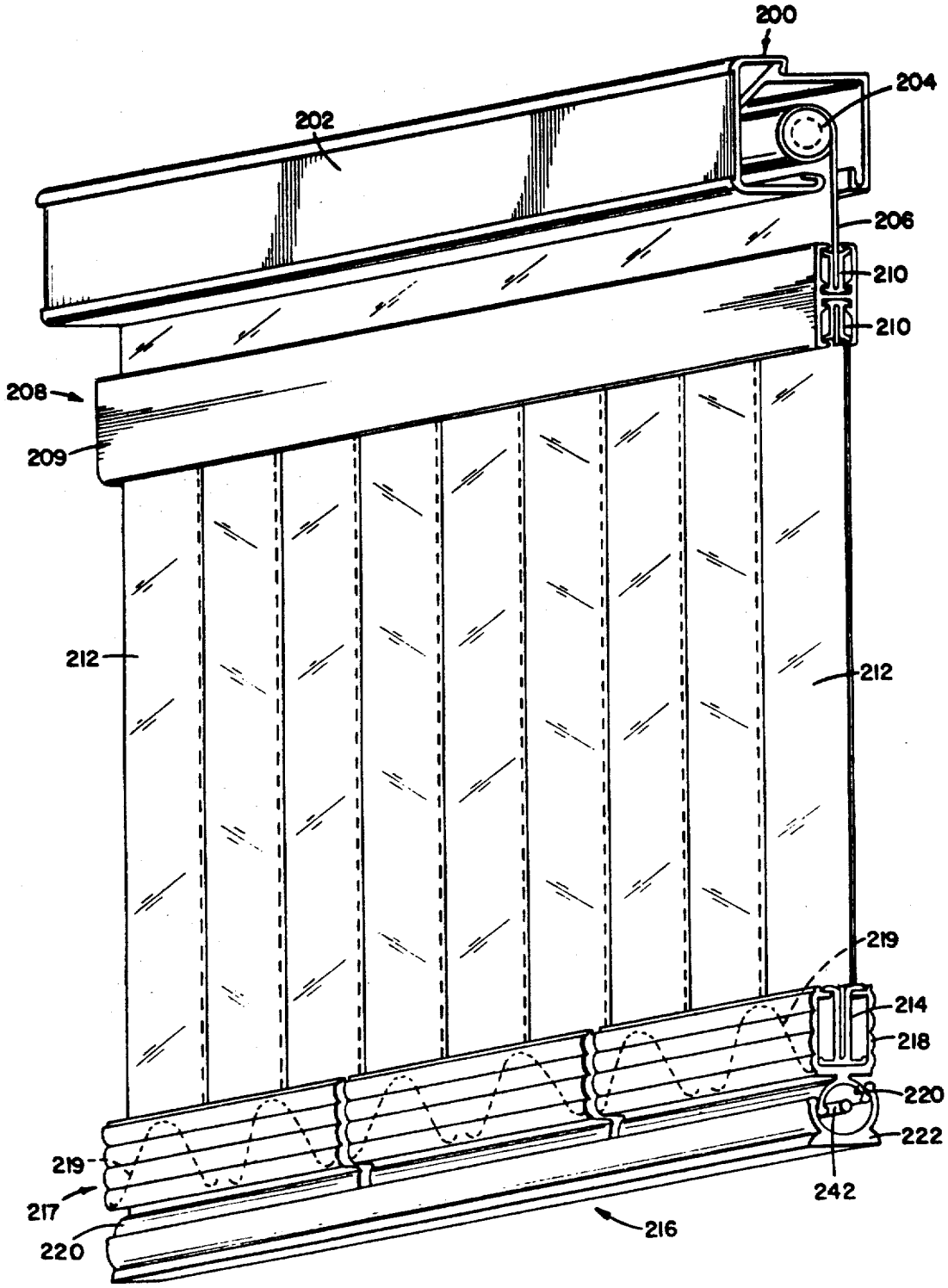
FIG. 13 is a perspective of an alternate embodiment of the present invention.
Figure 14:
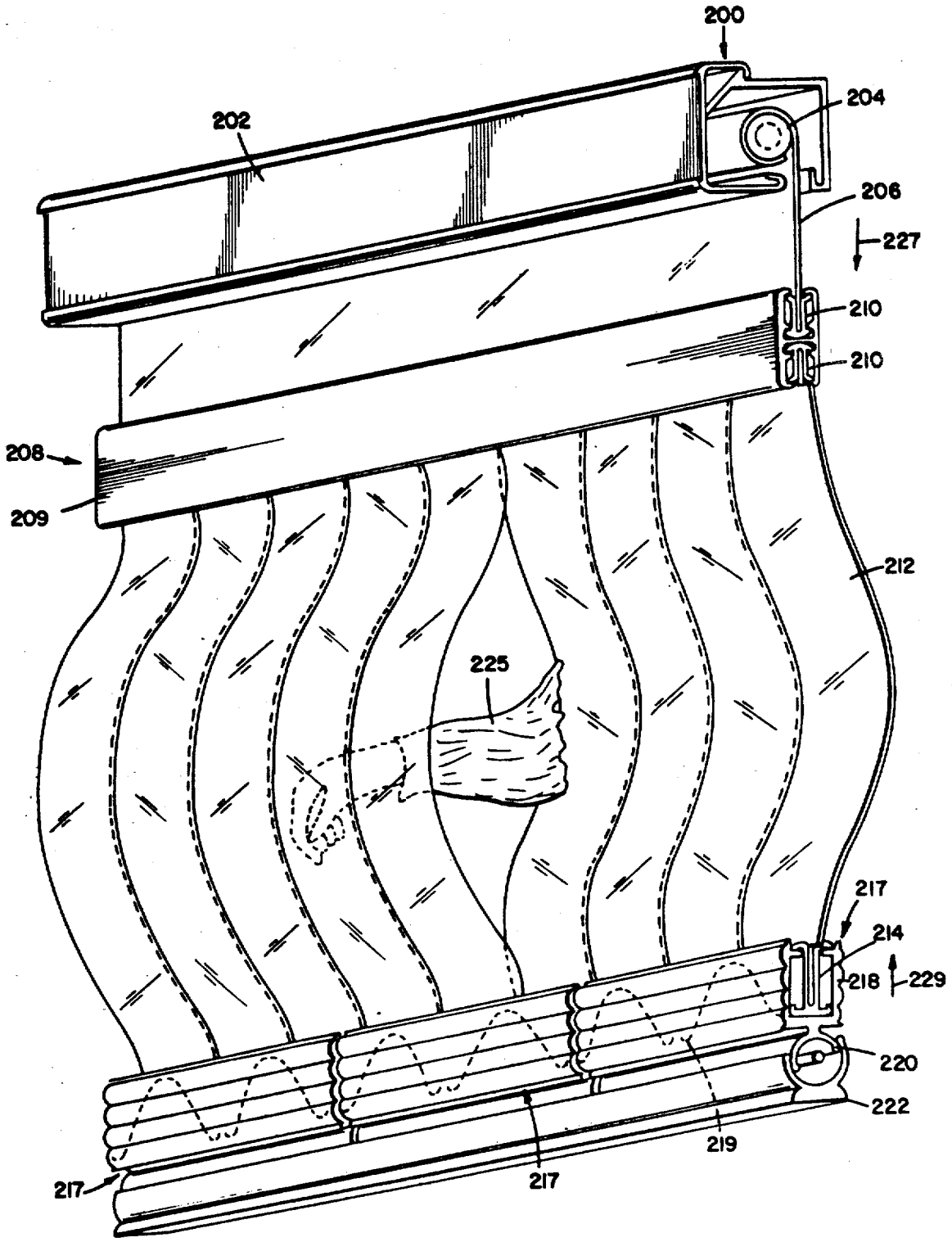
FIG. 14 illustrates device of FIG. 13 "in use"

Since the embodiment of FIG. 13 is intended primarily, though not exclusively, for installation across vertically oriented apertures, there is provided an upper mounting assembly 200 and a lower mounting assembly 216. The upper mounting assembly 200 comprises a housing 202 and an enclosed spring-tensioned roller 204. This assembly is substantially the same as the tensioning device 36 shown in FIG. 4. Wound on roller 204 is a single sheet 206 of a material which may be of the same kind constituting the panels 212. The sheet 206 serves to couple the panels 212 to the roller 204 through a coupling member 208. If one end of each individual panel 212 was attached directly to the roller 204 and permitted to be wound around the roller, the overlapping nature of the panels would result in uneven rolling, producing bulges and wrinkles, and would make the removal and replacement of individually damaged panels difficult. In order to avoid these problems, the individual panels 212 are coupled to the roller 204 by the single sheet 206 through coupling member 208.

Coupling member 208 comprises an outer housing 209 and shallow cuff members 210. The cuff members 210 are designed to be slideably insertable within back-to-back cavities provided in housing 209. One of these cavities opens vertically upward, the other opens vertically downward. The cuff member fits within the cavity and secures sheet member 206 to one side of the coupling member 208. The shallow cuff member 210 which is retained within the downward opening vertical cavity of coupling member 208 is preferably made in segments, each segment serving to secure one end of a small number of panels to the downward side of the coupling member 208. This allows for removal and replacement of damaged panels in small groups without having to totally detach the coupling member 208 from the lower mounting assembly 216.

Rail assembly 217 comprises a housing 218 and its associated arcuate guide member 220 together with a deep cuff member 214. The coupling member 208 and the rail assembly 217 are coupled together by the individual panels 212. The rail assembly 217 is segmented and together with track member 222 and rod 242 comprises the lower mounting assembly 216. The deep cuff member is also preferably segmented in a manner similar to the segmentation of the shallow cuff member 210 which fits in the downward opening cavity of coupling member 208. The deep cuff member 214 is suitably retained within a housing 218 which is part of the rail assembly 217. Both the guide member 220 and track member 222 are arcuate members with the outside diameter of the guide member being slightly less than the inside diameter of the track member such that the rail assembly 217 has a certain limited freedom to rotate about the longitudinal axis of the track member 222. The utility of this feature will be explained below.

Spring members 219 (see FIG. 30 for alternate embodiment) are retained between an upwardly facing surface of deep cuff member 214 and a downwardly facing surface of housing member 218. The reference to upward facing and downward facing is made with respect to the typical installation of the embodiment of FIG. 13 upon a vertically oriented aperture. The springs 219 thus tend to retain the deep cuff member 214 in contact with the base of the housing member 218 while at the same time allowing flexibility in the actual location of cuff member 214 within housing 218. This flexibility of position permits the lower mounting assembly 216 to compensate for slight misalignments in the panels 212 and misalignments between the upper mounting assembly 200 and the lower mounting assembly 216 which should preferably be parallel. Without this flexibility the panels would not remain in their slightly overlapping and touching position since vertical tension across the cuff member 214 would be uneven.

In order to reach merchandise stored behind the panels, a person would thrust his arm 225 (see FIG. 14) between adjacent panels 212 and grasp the item of merchandise. To accommodate the insertion of the arm 225 between adjacent panels coupling member 208 is drawn toward the arm (in the direction of arrow 227) and sheet member 206 unrolls slightly from the spring-tensioned roller member 204. Because the coupling member 208 is drawn toward the deep cuff member 214 as any two adjacent panels are parted, the distance between the opposing ends of each panel is decreased thereby removing tension from all but the two parted panels. Thus, even if the item being passed through the panels is large and the two panels are parted to an extent that they encounter and part additional panels, the additional panels are not under tension and no increase in force is required to part the additional panels. The spring-tensioned roller 204 and the spring-loaded deep cuff member 214 in combination with the natural resiliency of the panels 212 thus allows a person to withdraw an item of merchandise through the panels 212 much more easily and of considerably larger size than would be possible if the opposing ends of the individual panels were rigidly affixed to the sides of the aperture.

Figure 15:
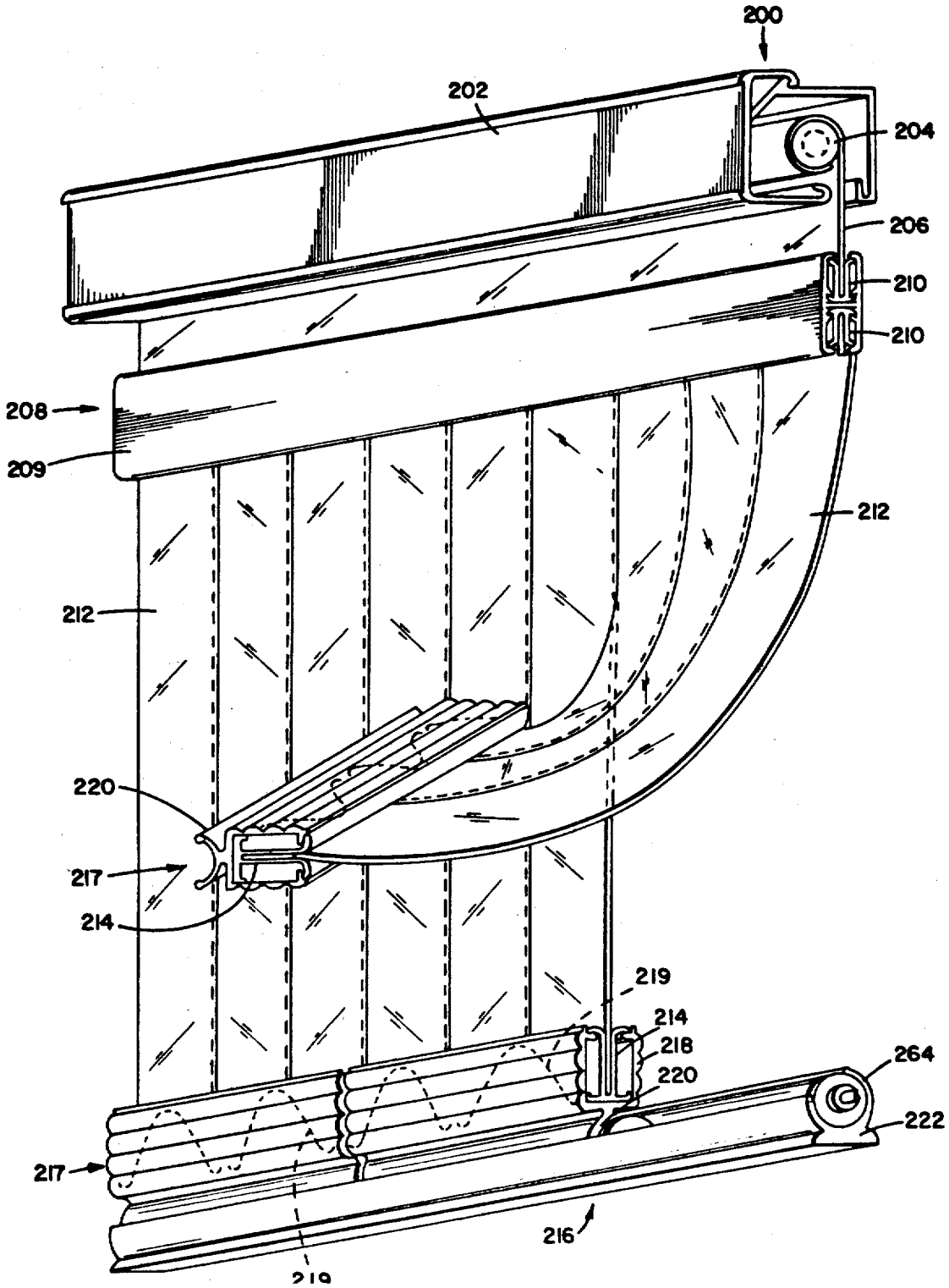
FIG. 15 illustrates the method of removing a group of panels from this embodiment.

As shown in FIG. 15 the panels 212 are, in the preferred embodiment, mounted in groups of three. One end of a group of three panels is mounted in a shallow cuff member 210 and slidingly inserted into the downward facing cavity of coupling member 208. The other end of the same three panel members are inserted into the deep cuff member 214 which itself is inserted into the housing 218 of a rail assembly 217. The rail assembly 217 is then fitted into the track member 222. The panels 212 are mounted in groups of three panels per cuff in order to facilitate easy removal of and replacement of a damaged panel without the requirement to totally detach the coupling member 208 from the lower mounting assembly 216. The manner of fitting the rail assembly 217 into the track member 222 is explained below.

Figure 16:
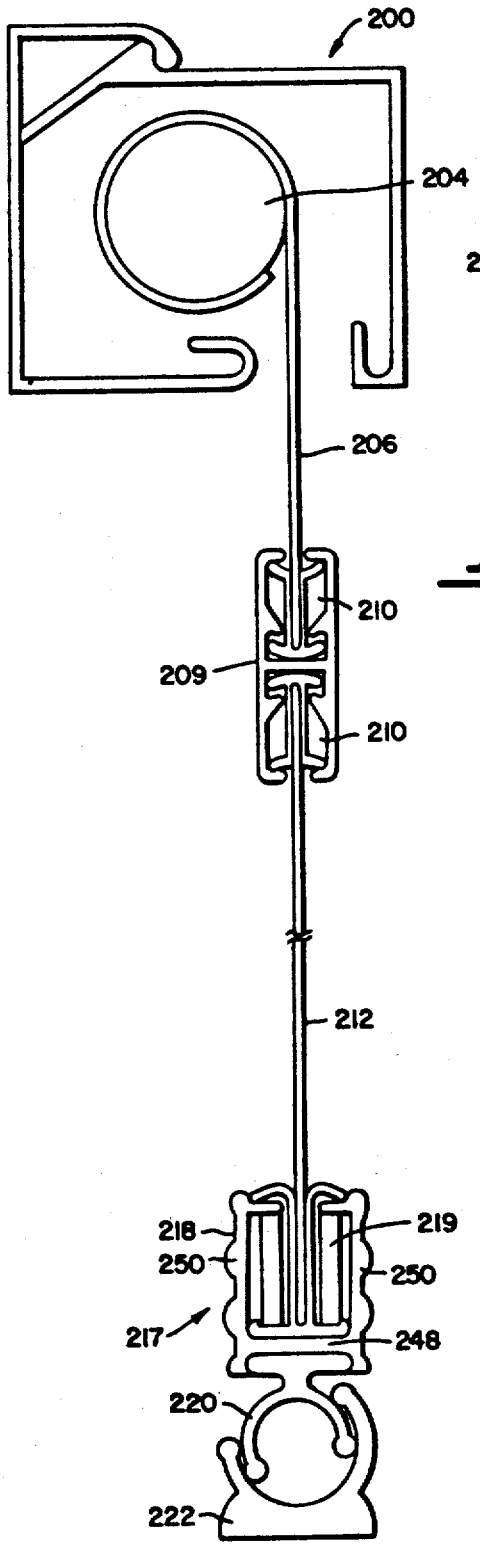
FIG. 16 is an end view of an alternate embodiment of the lower mounting means.

FIG. 16 shows an end-on view illustrating a slightly different construction of the rail assembly 217. In FIG. 16 the rail assembly 217 is comprised of a housing member 218 having side-walls 250 and comprised of an attached guide member 220 which is somewhat arcuately-shaped. Both the housing member and the guide member are described in more detail below. This constuction should be compared with the construction shown in FIG. 13 where the rail assembly was of unitary construction.

Figure 17:
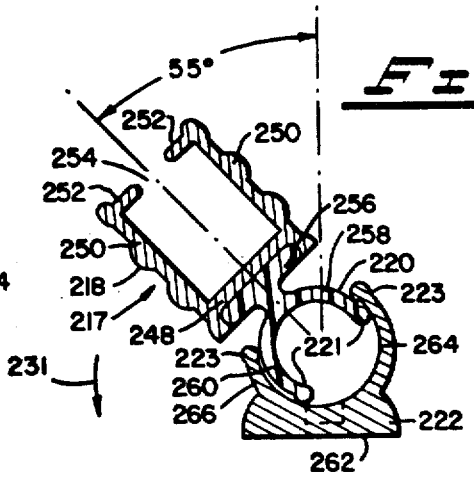
FIG. 17 is a cross-sectional view of the lower mounting means rotated rearwardly.

The rail and track assemblies are shown in greater detail in FIG. 17. The rail assembly 217 comprises a housing 218 and a guide member 220. The housing member 218 has a base portion 248 and is provided with two opposing sidewalls 250 extending perpendicularly upward from the base. At the top of each of the sidewalls 250 and projecting inwardly toward one another are located lateral projections 252. The space between the ends of the lateral projections 252 define a gap 254 which extends longitudinally the full length of the housing member 218. The base 248 of the housing member 218 is provided with a recess which is designed to accept the base 256 of the guide member 220. The guide member is provided with a first arm 258 and a second arm 260 which together define an arcuate section. The outside diameter of this arcuate section is slightly smaller than the inside diameter of the corresponding arcuate section provided on the track member 222. The track member comprises a base 262 and a first arm 264 and second arm 266 which combine to form an arcuate section complementary to the arcuate section of the guide member 220. The guide member 220, as illustrated in FIG. 17, is preferably constructed of a somewhat rigid nylon. As can be seen from an examination of FIG. 17, the rail assembly 217 is free to rock back and forth about the longitudinal axis of the track member 222.

Figure 19:
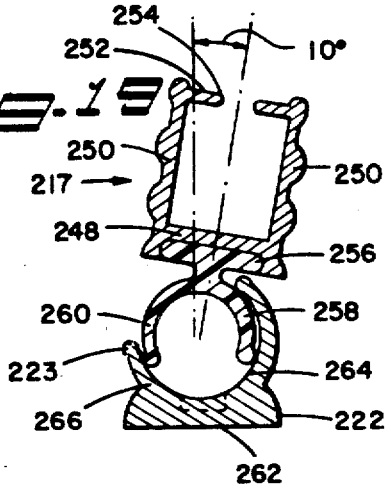
FIG. 19 is a cross-sectional view of the lower mounting means rotated forwardly.
Figure 18:
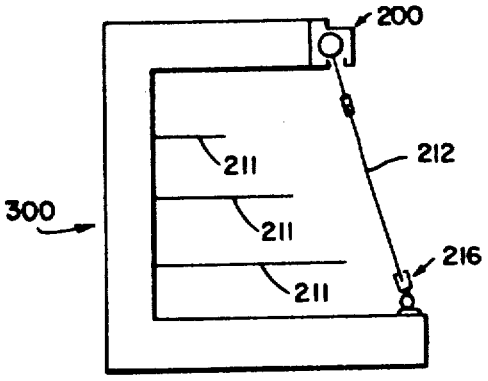
FIG. 18 illustrates a refrigerated display which requires rearward rotation of the lower mounting means.

The range of angular displacement of the rail assmbly 217 within the track member 222 is determined by the length of the arcuate arms 264 and 266 of the track member 222 and the length of the arcuate arms 258 and 260 of guide member 220, as well as the relative position of the guide member within the track, i.e., whether the guide member is in its normal position or "reversed" position. For a clear understanding of this explanation, reference should be made to FIGS. 17 and 19. In the present embodiment, it is preferred that one of the two arcuate forms of both the guide member and the track member be longer than the other. As shown in FIGS. 17 and 19 the guide member has a long arm 260 and a short arm 258. Track member 222 has a long arm 264 and a short arm 266. As shown, the long arm 260 of the guide member is adjacent the short arm 266 of the track member. This allows angular rotation of the rail assembly within a range of 10° from vertical on one side (FIG. 19) to 55° from vertical on the other side (FIG. 17). If the guide member is now removed and reinstalled in track member 222 such that its long arm 260 is adjacent the long arm 264 of the track member the range of angular rotation is changed. The rail assembly will then be able to rotate in the range from 25° on the same side of vertical as shown in FIG. 17, all the way downward to 85° from vertical on the same side. By changing the position of track member 222 so that the long arm 264 is located on the left hand side (as referenced to FIGS. 17 and 19) and appropriately positioning the long and short arms of the guide member similar ranges of rotation will occur toward the right hand portion of FIG. 17. Thus, by proper positioning, the rail assembly can be made to rotate within a range of 85° from vertical on one side to 85° from the vertical on the other side. As shown in FIG. 17, the rail assembly 217 must be rotated in the direction of arrow 231, i.e. against the normal tension in panels 212 to remove the rail assembly from the track. This broad latitude enables the mounting assembly of FIGS. 17 and 19 to accommodate refrigerated units 300 such as shown in FIGS. 18 and 20, i.e., the shield may be required to accommodate a recessed (FIG. 18) or an overhanging (FIG. 20) refrigerated unit. The relative position of the track member and guide member is preferably chosen such that in normal use the angular displacement of the guide member will not approach the maximum possible. Displacement to the maximum is only intentionally performed when it is desired to detach the rail assembly 217 from the track member 222 for the purposes of restocking the refrigerated units or for replacing a damaged panel.

As shown in FIG. 17 the arms 258 and 260 of the guide member, and arms 264 and 266 of the track member are provided at their free ends with a bead. The bead provided on the guide member is designated as 221 and the bead provided on the track member is designated as 223. The sizing of the guide member and track member is such that when the rail assembly 217 is at its maximum angular displacement it can be easily snapped out of the track member 222. If the rail assembly 217 is not at its maximum angular displacement it is much more difficult and becomes progressively more difficult to snap the guide member out of the track member as the displacement of the rail assembly 217 leaves the maximum.

Although the rail assembly 217 is designed to be easily snapped out of the track member 222 when the rail assembly is at its maximum angular displacement it is undesirable for it to be too easily snapped free of the track member. This could occur by accident if a shopper or a child was to lean on the rail assembly 217 causing it to rotate. To help guard against such accidental uncoupling of the guide member and track member, the track member 222 is provided with a rod 242 and a locking bushing 240 which helps to retain the rail assembly 217 within the track member even when the rail assembly is at its maximum angular displacement. This locking bushing 240 is illustrated in FIG. 21. A rod 242 passes through the center of a plurality of such bushings. The rod is crimped on each side of each locking bushing 240. The rod thus retains the locking bushings in place aligned within the track member 222. The locking bushings 240 are located between each adjoining rail assembly and at each end of the track member 222. These locking bushings are more fully illustrated in FIGS. 22 and 23.

As shown in FIG. 23 each locking bushing is provided with an axially extending protrusion 246. This protrusion has an axially extending surface 249 which extends sufficiently inward within the arcuate arms of the guide member 220 such that when the rail assembly 217 is at its maximum angular displacement, the arm of the guide member 220 will contact the axially extending surface 249 preventing the guide member 220 from snapping out of the track member 222 without an additional force being exerted to pull the guide member over the somewhat resilient axially extending protrusion 246. The rod 242 serves the same purpose (i.e. rotation of the rail assembly will cause an arm of the guide member to hook under rod 242 so as to prevent accidental removal of the rail assembly from the track member) and in addition serves to require an additional keying motion to insert the guide member 220 into the track member 222. The presence of these locking bushings 240 and the crimping of rod 242 also serves to keep the placement of the rail assembly 217 properly aligned with the corresponding shallow cuff member 210 which is attached to the opposite end of the same panels.

Figure 24:
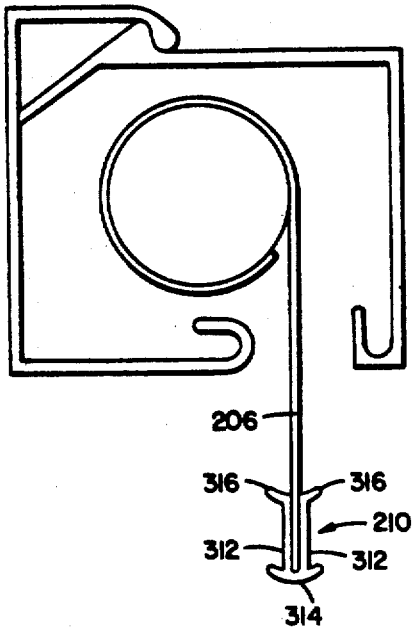
FIG. 24 is an end view of a shallow cuff member.
Figure 26:
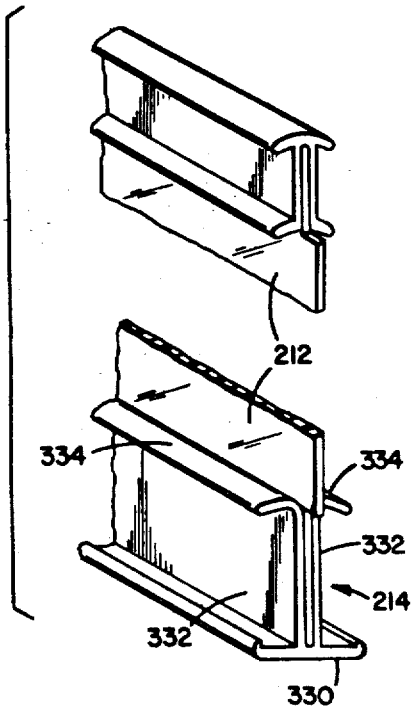
FIG. 26 is a perspective of a section of a shallow cuff member and the deep cuff member.

FIGS. 24, 25 and 26 are used to show the cooperation between the shallow cuff members 210, the coupling member 208 and the deep cuff member 214. The shallow cuff member is attached to the free end of the sheet 206 which is attached to the spring-tensioned roller member 204. Cuff member 210 has two vertical sidewalls 312 and a base member 314 which extends beyond the sidewalls 312 and joins one edge of the sidewalls 312 together. The free edge of the sidewalls 312 are each provided with laterally extending end protrusions 316. The base 314 and the combination of the lateral end protrusions 316 are each somewhat arcuate and are designed to secure the sheet 206 to the coupling member 208.

The coupling member 208 is generally in the shape of a letter H and is symmetric above and below the horizontal cross-member 324 joining the two sides of the letter H (see FIG. 25). The coupling member 208 thus defines a cavity both above and below the crossmember 324. The sidewalls 321 of the cavities are provided on their interior surfaces with projections 322 which extend toward the cross-member 324. These projections are somewhat in the shape of a hook. At the free ends of the sidewalls 321 are provided inwardly extending flanges 320. The shallow cuffs 210 are designed for insertion in the cavities of coupling member 208 in such a manner that the base member 314 of the cuff fits between the cross-member 324 of the coupling member and the internal projections 322. The lateral end flanges 316 contact the interior surface of the inwardly extending flanges 320. The contacting of these various surfaces serves to secure the cuff 210 within the cavity of the coupling member 208. Cuff member 210 which is inserted into the upper cavity of the coupling member 208 is of unitary construction. Cuff member 210 which is inserted into the lower cavity of the coupling member 208 is preferably of segmented construction, that is the coupling member may be lengthwise divided into typically three separate cuff member sections. Each section is designed to accommodate typically three or more panel members in overlapping relationship. Because the lower shallow cuff member is of segmented construction, a damaged panel may be removed and replaced without the necessity of removing all of the panels from the coupling member 208. The opposite end of the panels 212 are secured to a likewise segmented deep cuff member 214 (see FIG. 26). The deep cuff member is similar in construction to that of the shallow cuff member except that the base flange 330 is flat rather than arcuate and the end flanges 334 are slightly bent toward the base flange 330. The sidewalls 332 of deep cuff member 214 are deeper than those of the shallow cuff 210. The depth of the sidewalls 332 is determined by the construction of the housing portion 218 of the rail assembly 217. As shown in FIG. 16, the base flange 330 of the deep cuff 214 is designed to contact the interior surface of the base 248 of the housing portion 218. The laterally extending flanges 334 are designed to contact the exterior surface of the inwardly directed protrusions 252 of the housing member 218. These contacts are maintained by means of a spring 219 shown in FIGS. 13, 14 and 16.

Figure 28:
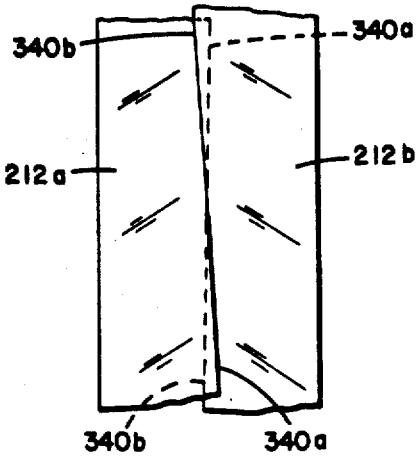
FIG. 28 is a plan view of a portion of two adjacent panels illustrating a particular method of overlap.

While the panels referred to herein have been described generally as transparent rectangular panels it is contemplated that the cross-section of the panel may appear as shown in FIG. 27. Along each edge of the panel would be provided a bead 340 which would be somewhat oblong in cross-section and would extend both above and below the plane of the panel 212. This configuration of the panel would be particularly appropriate for the overlapping of the panels in the manner illustrated in FIG. 28. FIG. 28 illustrates an overlapping configuration of the panels 212 whereby adjacent panels are overlapped at one end such that a first panel such as 212A is beneath a second panel such as 212B. At the opposite end of these two panels they are overlapped such that panel 212B is beneath panel 212A. This provides a sort of snaking or twisted overlapping. When the panels are overlapped in this fashion their tendency to adhere to one another is greatly reduced by the use of the beads 340 shown in FIG. 27. Thus, in FIG. 28 panel 212A is provided with a bead 340A which lies beneath panel 212B and which at the opposite end lies above panel 212B. Similarly, panel 212B is provided with a bead 340B which at its upper edge is above panel 212A and at its opposite end, is beneath panel 212A. The use of the beads 340 means that the flat surfaces of the panels are held away from each other and thus their tendency to adhere to one another is greatly reduced. Contact of the panels is restrained to occur only along the edges of the beads 340 thus reducing the friction between the panels and reducing the effort needed to insert an arm between the panels 212A and 212B.

Figure 29:
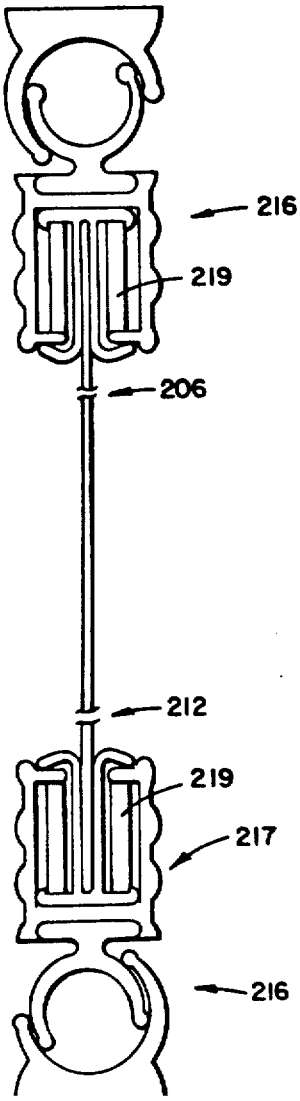
FIG. 29 is a cross-sectional view of an alternate embodiment of the means for disposing the panels across an aperture particularly suited for use where installation space is limited.

A second alternate embodiment of the means for disposing the panels 212 across an aperture is illustrated in FIG. 29.

FIG. 29 illustrates an embodiment of the present invention very much similar to that shown in FIG. 16. The only differences between the embodiment shown in FIG. 29 and that illustrated in FIG. 16 is the nature of the upper support member shown as 200 in FIG. 16 which is replaced by the lower mounting assembly 216 in FIG. 29 and no coupling member (42 or 208) is used in FIG. 29. This produces an embodiment of the invention which has a much smaller upper support member than that shown in FIG. 16. The embodiment of FIG.

29 does, however, lack the great flexibility provided to the system of virtue of the spring-tensioned roller 204 and coupling member. Since the embodiment to FIG. 29 cannot expand as much as the embodiment illustrated in FIG. 16, and since the embodiment of FIG. 29 has a more compact upper support member 216, this particular embodiment is particularly suited for use in small spaces where it is pretty much predetermined that relatively small items of merchandise will be withdrawn from behind the panels 212. Such a situation is typified by the upright refrigerated units having vertically hinged glass doors typically used to store such items as soft drinks (bottled and canned); bottled fruit juices; alcoholic beverages, such as beer and malt liquor; and similarly sized articles. Because these hinged glass doors are frequently opened and closed the use of the particular embodiment of the invention illustrated in FIG. 29 would greatly reduce the loss of cold air which occurs when the doors are opened. The size of the motors necessary to drive the compressors could correspondingly be reduced since the efficiency of the refrigerated unit would be increased by the use of the embodiment of FIG. 29 just as is the case in other described embodiments. While the particular embodiment of FIG. 29 lacks the great degree of flexibility provided by the spring-tensioned roller member 204 shown in FIG. 16, the use of two lower mounting assemblies 216 means that there are now two deep cuff members 214 and thus the embodiment of FIG. 29 does compensate somewhat for the loss of the spring-tensioned roller 204. Additional compensation can be provided by designing the deep cuff members to be even deeper than those shown in FIG. 16. However, since the typical article of merchandise withdrawn from behind the embodiment of FIG. 29 is generally within a predetermined range and classified as relatively small articles of merchandise, this particular embodiment does not require as great a degree of expandability as is designed into the embodiment of FIG. 16. It should be evident that other embodiments comprised of various combination and permutations of the various upper and lower mounting assemblies are possible. For example, the spring tensioned roller 204 could be used in combination with the mountings of either FIGS. 5, 7 or 8.

Figure 30:
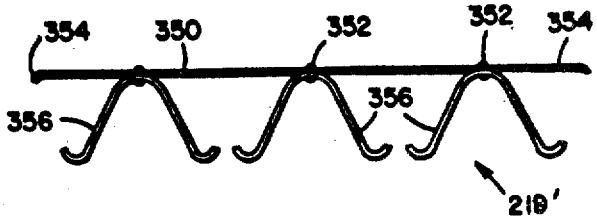
FIG. 30 is a detailed plan view of an alternate form of the spring member used to retain a cuff member within a housing member.

Referring now to FIG. 30 there is shown a spring assembly 219′ which may be used as an alternate to the springs 219 used to resiliently retain the deep cuff member 214 within housing member 218. The spring assembly 219′ is comprised of a joining member 350 which is joined to the individual spring elements 356 by suitable fastening means 352. The ends of the joining member are curved as at 354 such that when the spring assembly 219′ is installed upon the deep cuff member 214 a gap exists between the end flange 334 of deep cuff member 214 and the curved end portion 354 of the spring assembly 219′. This gap facilitates insertion of the deep cuff member 214 and spring assembly 219′ within housing 218. The gap serves as a target for insertion of the inward protrusions 252 of housing 218. A spring assembly 219′ is first placed in position on both sides of the deep cuff member 214 (see FIG. 16). The deep cuff member is then inserted into housing 218 by guiding the protrusions 252 into the gap formed between the curved portion 354 and flange 334. If the springs 219 of FIGS. 13–15 (i.e. individual springs) are used, the crest of each spring 219 is dimpled upward, and a series of holes is drilled into the horizontal projections 252 of housing 218 such that the dimples seat the springs 219 into the holes and retain the springs 219 in place during insertion of deep cuff member 214.

Figure 31A:
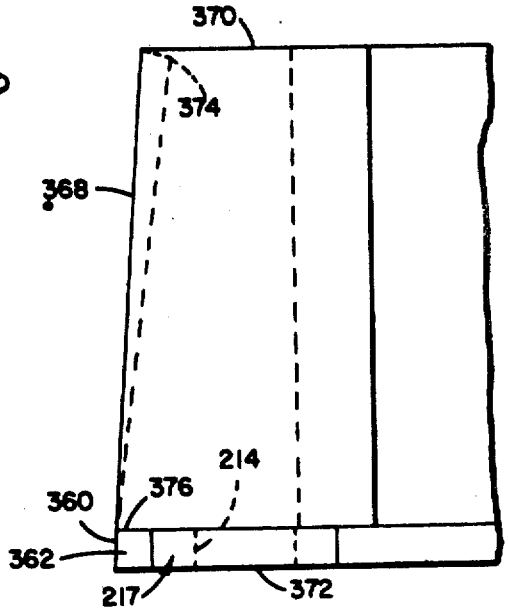
FIGS. 31*a* and 31*b* illustrate the capability of the present invention to effectively seal even an aperture that is not square.
Figure 31B:
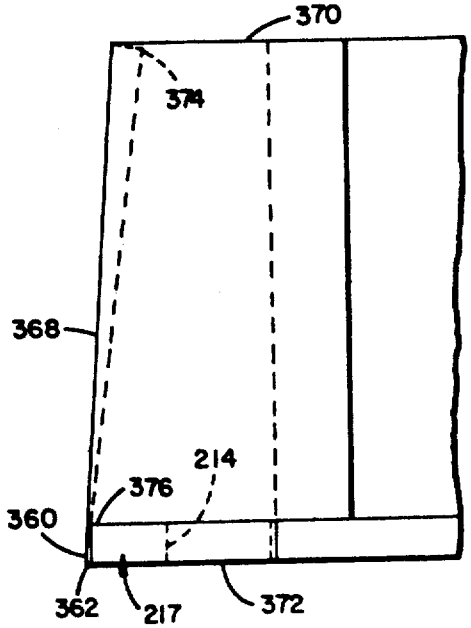

FIGS. 31*a* and 31*b* are used to illustrate one particular advantage of the construction of the rail assembly 217 and deep cuff member 214 earlier described.

It is quite common to encounter apertures in uncovered refrigerated units which are not precisely square, even though the top and bottom edges of the aperture are parallel. While nonparallel top and bottom aperture edges can be accommodated by reason of the spring loaded cuff member 214, the problem of the non-square corner requires a different solution.

The problem of the non-square corner is illustrated in FIG. 31*a*. Although the top edge 370 and bottom edge 372 of the aperture are parallel the left hand edge 368 does not form a square corner with either. To partially accommodate this condition the upper left hand corner 374 of a panel may be tucked behind the panel and the bottom left hand corner 376 may be brought to just meet the left hand edge 368. The panel thus can be made to follow the non-square left hand edge for most of its length. However, an opening 362 will exist between that portion of the panel that extends beyond the end of rail assembly 217 and the lower edge 372 at the left hand end of the rail assembly. If the opening is not filled much cold air will flow out the opening.

FIG. 31*b* shows how the opening is filled. In FIG. 31*a* the deep cuff member 214 was in its normal position centered lengthwise within rail assembly 217. To fill the opening, the rail assembly 217 has been slid toward the left with respect to the deep cuff member 214 which has not moved at all. The rail assembly thus moves into and substantially fills the opening 362 without affecting the cooperation of the rail assembly 217 and deep cuff member 214. Similarly the succeeding rail assemblies along the lower edge 372 are all shifted toward the left and thus only the last rail assembly at the far right hand edge (not shown) need be custom cut to size. Without the ability to shift the deep cuff member 214 with respect to the rail assembly 217, two rail assemblies, one at each end of the lower edge 372 would have to be custom cut. Because this solution does not require movement of the deep cuff member 214 with respect to the corresponding shallow cuff member 210, the panels themselves remain mounted squarely and thus retain an overlapped and touching configuration.

Although the present invention has been described in connection with the particular embodiments of FIGS. 1 through 31*b*, it is to be understood that many other alterations and modifications may be made by those having ordinary skill in the art without departing from the spirit and scope of the present invention.

It should further be understood that a wide variety of combinations and permutations of the various devices discussed herein may be constructed to suit a particular situation. For example the spring-tensioned roller device shown in FIG. 4 may be used in combination with any one or more of the rotatable fixtures shown in FIGS. 5 through 10. In addition a plurality of any such rotatable fixtures may be used in place of the spring-tensioned roller and in combination with other rotatable fixtures at the opposite side of the aperture. In the latter case the coupling fixture would not be used, as each panel would be connected directly to the rotatable fixture at each end of the panel, just as each end of the panel members are connected directly to the rail and track assemblies shown in FIG. 29.

What has been described is an apparatus for reducing the electrical consumption primarily but not limited to supermarket refrigerated displays. It is also expected that the present invention will extend the life of refrigeration equipment, such as motors, generators and compressors, as well as decreasing maintenance required on the same. Refrigerated units, incorporating the present invention's design, may also be built with smaller refrigeration capacities and therefore may be built in a more economical manner. In addition, advantages are obtained with respect to space airconditioning and heating in markets employing a large number of open display refrigerated devices. It will no longer be necessary to heat the market's air space due to the large heat sinks formed by the open refrigerated display cases. In addition, with the more uniformly maintained temperature within the refrigerated devices, which the present invention will allow, it is also expected that the shelf-life of refrigerated food stuffs will be extended. The degree of consumer comfort will also be increased in the proximity of a large number of refrigerated display devices thereby permitting the consumer to view the merchandise without subjecting himself to a locally cold environment.

I claim:

1. An access shield for thermally isolating an aperture in a refrigerated device from the ambient environment while permitting access through said aperture, comprising:

a plurality of resilient and substantially transparent panels having a first and second end wherein said one of said panels is adjacent to and partially overlaps at least one other of said panels;

means for disposing said panels across said aperture and tensioning each of said panels;

means for coupling said first end of said panels to said means for disposing and tensioning; and means for securing said second end of said panels along a side of said aperture; said means for securing comprising:

(i) at least one rail assembly joined to said second end of said panels, said rail assembly having a guide member, and (ii) a track member defining an elongated slot for selectively engaging said guide member, said track member having a longitudinal axis, and permitting said guide member to rotate therein about said longitudinal axis.

2. An access shield according to claim 1 wherein each panel is provided with a bead along its longer sides, said bead extending outwardly on both sides of the plane of said panels.

3. An access shield according to claim 2 wherein a first portion of an edge of a first panel lies in front of a first portion of an edge of a second panel and a second portion of said edge of said first panel lies in back of a second portion of an edge of said second panel.

4. An access shield according to claim 1 wherein said rail assembly comprises:

a housing portion defining a longitudinal opening extending along one side thereof;

a cuff member having a base flange joined to two end flanges, said cuff member being disposed in said chamber such that said two end flanges project through said longitudinal opening; and a spring member disposed in said housing and urging said base flange away from said opening;

whereby said panels are resiliently retained between said securing means and said means for disposing and tensioning.

5. An access shield according to claim 1 wherein said means for disposing said plurality of panels across said aperture and tensioning said panels comprises:

a track member of generally arcuate cross-section having a slot extending longitudinally along said track member; and at least one rail assembly provided with an arcuate guide member for coupling said at least one rail assembly to said track member, said slot spanning an arc sufficient to permit said arcuate guide member to pass therethrough whereby said rail assembly is coupled to said track member so as to permit said rail assembly to rotate a limited extent about the longitudinal axis of said track member.

6. An access shield according to claim 5 wherein the generally arcuate cross-section of said track member comprises a first arm and a second shorter arm, the free ends of said arms defining a slot extending longitudinally along said track member and wherein said guide member also comprises a first arm and a second shorter arm.

7. An access shield according to claim 1 wherein said means for coupling said first end of said panels to said means for disposing and tensioning comprises:

first and second interconnected cuff members, said first cuff member joined to said panels and said second cuff member joined to said means for disposing and tensioning.

8. An access shield according to claim 7 wherein said means for coupling comprises a housing member defining first and second chamber, said first chamber for receiving and securing therein said first cuff member and said second chamber for receiving and securing therein said second cuff member.

9. An access shield according to claim 1 or 7 wherein said guide member has a generally arcuate cross-section and said slot is configured such that said rail assembly is rotatable in said track member through a predetermined arc.

10. An access shield assembly for thermally isolating an aperture in a refrigerated device from the ambient environment while permitting access through said aperture, comprising:

a plurality of resilient, substantially adjacent and transparent panels having first and second ends;

means for disposing said panels across said aperture and tensioning each of said panels;

means for coupling said first end of said panels to said means for disposing and tensioning, said means for coupling comprising a housing defining first and second chambers, a first cuff member disposed in said first chamber and a second cuff member disposed in said second chamber, said first cuff member joined to said first end of said panels and said second cuff member joined to said means for disposing and tensioning; and means for securing said second end of said panels along a side of said aperture, said means for securing comprising a rail assembly joined to said second end of said panels and means for engaging said rail assembly, said engaging means having a longitudinal axis permitting said rail assembly to rotate therein about said longitudinal axis.

11. An access shield according to claim 10 wherein said rail assembly comprises:

a housing portion defining a longitudinal opening extending along one side thereof;

a cuff member having a base flange joined to two end flanges, said cuff member being disposed in said chamber such that said two end flanges project through said longitudinal opening; and a spring member disposed in said housing and urging said base flange away from said opening;

whereby said panels are resiliently retained between said securing means and said means for disposing and tensioning.

12. An access shield according to claim 10 wherein said means for disposing said plurality of panels across said aperture and tensioning said panels comprises:

a track member of generally arcuate cross-section having a slot extending longitudinally along said track member; and at least one rail assembly provided with an arcuate guide member for coupling said at least one rail assembly to said track member, said slot spanning an arc sufficient to permit said arcuate guide member to pass therethrough whereby said rail assembly is coupled to said track member so as to permit said rail assembly to rotate a limited extent about the longitudinal axis of said track member.

13. An access shield according to claim 10 wherein each panel is provided with a bead along its longer sides, said bead extending outwardly on both sides of the plane of said panels.

14. An access shield for thermally isolating an aperture in a refrigerated device from the ambient environment while permitting access through said aperture, comprising:

a plurality of resilient and substantially adjacent and transparent rectangular panels having first and second ends;

means for disposing said panels across said aperture and tensioning each of said panels;

means for coupling said first end of said panels to said means for disposing and tensioning; and means for securing said second end of said panels along a side of said aperture, said means for securing attached to said second end of said panels and including an arcuate guide member defined by a first arm and a second shorter arm, and a track member defining an elongated slot for selectively engaging said arm members and permitting said arm members to rotate therein.

15. An access shield according to claim 14 wherein said means for securing includes spring means for resiliently joining said second end of said panels to said means for securing.

16. An access shield according to claim 14 wherein said means for securing further comprises a housing with said guide members attached thereto and a cuff member, said cuff member resiliently disposed in said housing and attached to said second end of said panels.

17. An access shield according to claim 14 wherein each panel is provided with a bead along its longer sides, said bead extending outwardly on both sides of the plane of said panels.

18. An access shield according to claim 17 wherein a first portion of an edge of a first panel lies in front of a first portion of an edge of a second panel and a second portion of said edge of said first panel lies in back of a second portion of an edge of said second panel.

* * * * *

UNITED STATES PATENT AND TRADEMARK OFFICE

CERTIFICATE OF CORRECTION

PATENT NO. : 4,310,044

DATED : January 12, 1982

INVENTOR(S) : M. Allan Schenker

It is certified that error appears in the above-identified patent and that said Letters Patent is hereby corrected as shown below:

The drawings of the above patent should be deleted and the sheets of drawings as per attached substituted therefor.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*

Fig. 5
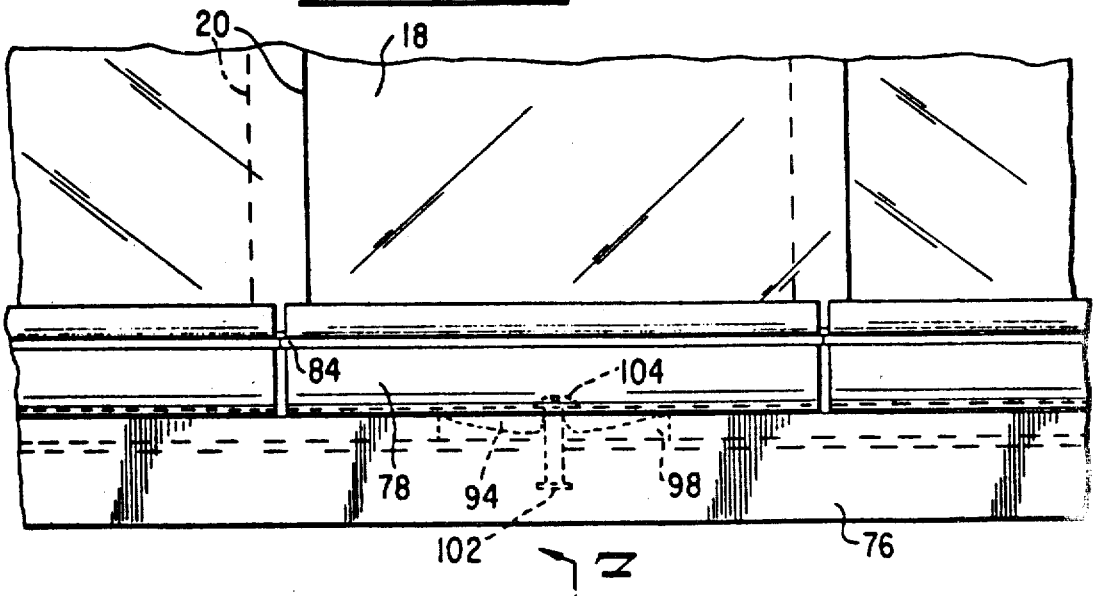
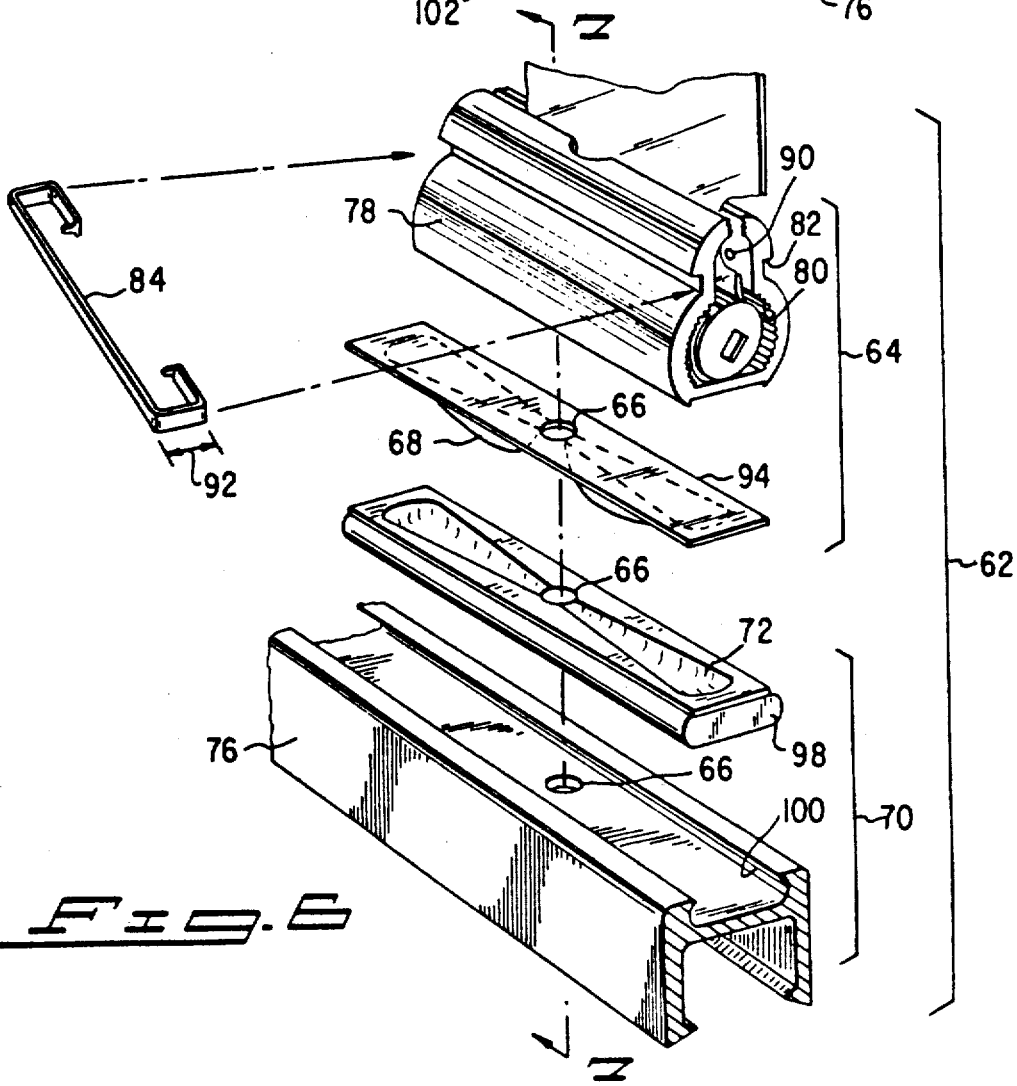
Fig. 6

Fig. 20
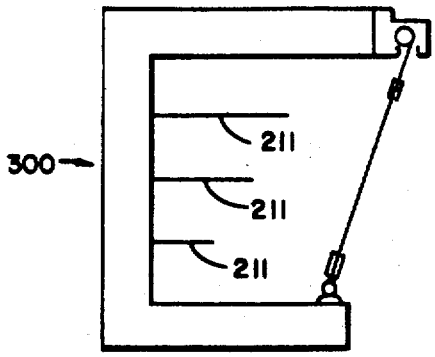
Fig. 23
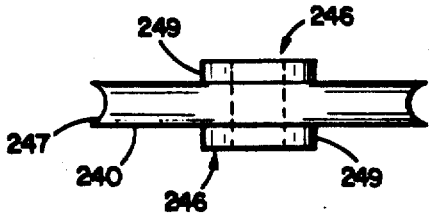
Fig. 25
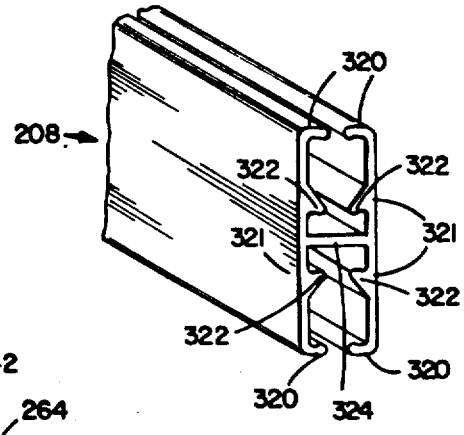
Fig. 21
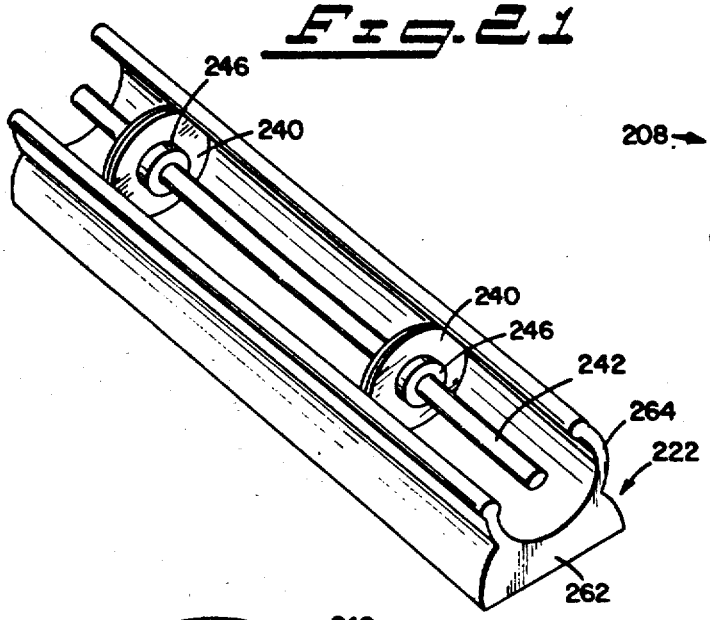
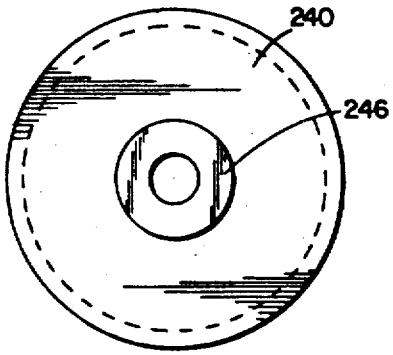
Fig. 22
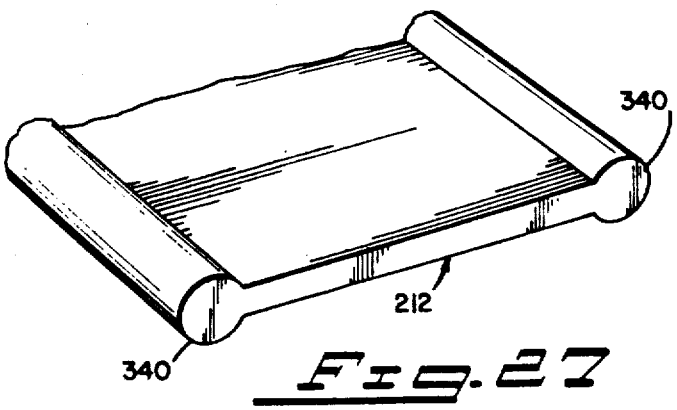
Fig. 27